US009914634B2

(12) United States Patent
McClellan

(10) Patent No.: US 9,914,634 B2
(45) Date of Patent: Mar. 13, 2018

(54) INJECTION MOLDED SADDLE WITH COVER

(71) Applicant: Brad McClellan, Vernal, UT (US)

(72) Inventor: Brad McClellan, Vernal, UT (US)

( * ) Notice: Subject to any disclaimer, the term of this patent is extended or adjusted under 35 U.S.C. 154(b) by 0 days.

(21) Appl. No.: 14/603,972

(22) Filed: Jan. 23, 2015

(65) Prior Publication Data

US 2015/0210531 A1 Jul. 30, 2015

Related U.S. Application Data

(60) Provisional application No. 61/931,130, filed on Jan. 24, 2014.

(51) Int. Cl.
*B68C 1/02* (2006.01)

(52) U.S. Cl.
CPC ..... *B68C 1/025* (2013.01)

(58) Field of Classification Search
CPC ..... B68C 1/02; B68C 1/025
USPC ..... 54/44.1, 44.7, 1
See application file for complete search history.

(56) References Cited

U.S. PATENT DOCUMENTS

| | | | | | |
|---|---|---|---|---|---|
| 3,258,894 | A * | 7/1966 | Hoaglin | B68C 1/02 | 54/44.7 |
| 3,712,024 | A * | 1/1973 | Nankivell | B68C 1/025 | 54/44.7 |
| 3,888,070 | A * | 6/1975 | White | B68C 1/025 | 54/44.7 |
| 3,911,648 | A * | 10/1975 | Lightfoot | B68C 1/025 | 54/44.5 |
| 4,860,524 | A * | 8/1989 | Dumoulin | B68C 1/025 | 54/44.7 |
| 5,174,934 | A * | 12/1992 | Saatchi | C08J 9/065 | 264/46.4 |
| 2009/0205295 | A1* | 8/2009 | Odermatt | B68C 1/126 | 54/44.3 |
| 2014/0338292 | A1* | 11/2014 | Abel | B68C 1/002 | 54/44.1 |
| 2015/0175403 | A1* | 6/2015 | Courouble | B68C 1/025 | 54/44.5 |
| 2016/0159637 | A1* | 6/2016 | Kahlbetzer | B68C 1/025 | 54/44.7 |

* cited by examiner

*Primary Examiner* — Lisa L Tsang
(74) *Attorney, Agent, or Firm* — Workman Nydegger

(57) ABSTRACT

A saddle may be manufactured through the injection molding of a core. The core may then be reinforced by the application of a pliable reinforcement layer, such as pre-impregnated epoxy glass, which may then be hardened. A finishing layer may then be applied to the reinforcement layer to complete the saddle.

19 Claims, 5 Drawing Sheets

INJECTION MOLDED SADDLE WITH COVER

CROSS REFERENCE TO RELATED APPLICATIONS

This application claims priority to and the benefit of U.S. Provisional Patent Application No. 61/931,130 entitled "INJECTION MOLDED SADDLE" filed Jan. 24, 2014, the disclosure of which is incorporated herein by reference.

BACKGROUND

Generally, this disclosure relates to the manufacture of horseback riding saddles. More specifically, the present disclosure relates to the manufacture of weather resistant, durable saddles through the utilization of synthetic materials to produce and build up a saddletree.

Saddle manufacturing technology has not changed substantially since saddle manufacturing began several thousand years ago. Leather saddles produced with a rigid saddletree have been in use for over 2000 years due to their strength and durability when used in poor weather and for long sessions of work. Traditionally, saddles are made with a wooden saddletree that functions as a frame upon which the final saddle may be built up using leather. Despite the durability of leather and wood and their ability to stand up to harsh weather conditions, traditional saddles made of leather and wood are not entirely impervious to water, dirt, and damaging harsh sunlight. The combination of these elements may produce an environment in which even a leather and wood saddle may begin to deteriorate.

Many people work outside on horseback in all weather conditions and require a durable, reliable saddle to provide a stable connection between them and their horse. Furthermore, weight savings in a saddle are beneficial both to the rider and to the horse. Therefore, it would be desirable to produce a strong, weather resistant, durable, lightweight saddle at low cost.

BRIEF SUMMARY OF THE DISCLOSURE

Embodiments of the present disclosure relate to a saddle or a method of manufacture of a saddle. In particular, embodiments of the present disclosure may relate to a saddle having a synthetic core and a hardened synthetic reinforcement layer to render the saddle lightweight, strong, and durable.

The method of manufacture may comprise injecting a curable fluid into a mold and then curing the curable fluid at least until the fluid is workable to create a core. The core is then reinforced with a reinforcement layer and the reinforcement layer is hardened. A finishing layer is applied over the reinforcement layer.

The method of manufacture may also include fully encapsulating the core with the reinforcement layer, and similarly, fully encapsulating the reinforcement layer with the finishing layer. The reinforcement layer may comprise a pre-impregnated epoxy glass that is hardened by heating the epoxy glass. The reinforcement layer may, additionally, vary in thickness or number of layers to selectively reinforce regions of the saddle that are subject to higher stresses during use.

Additional features and advantages of exemplary implementations of the disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. For better understanding, the like elements have been designated by like reference numbers throughout the various accompanying figures. While some of the drawings may be schematic representations, at least some of the drawings may be drawn to scale. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
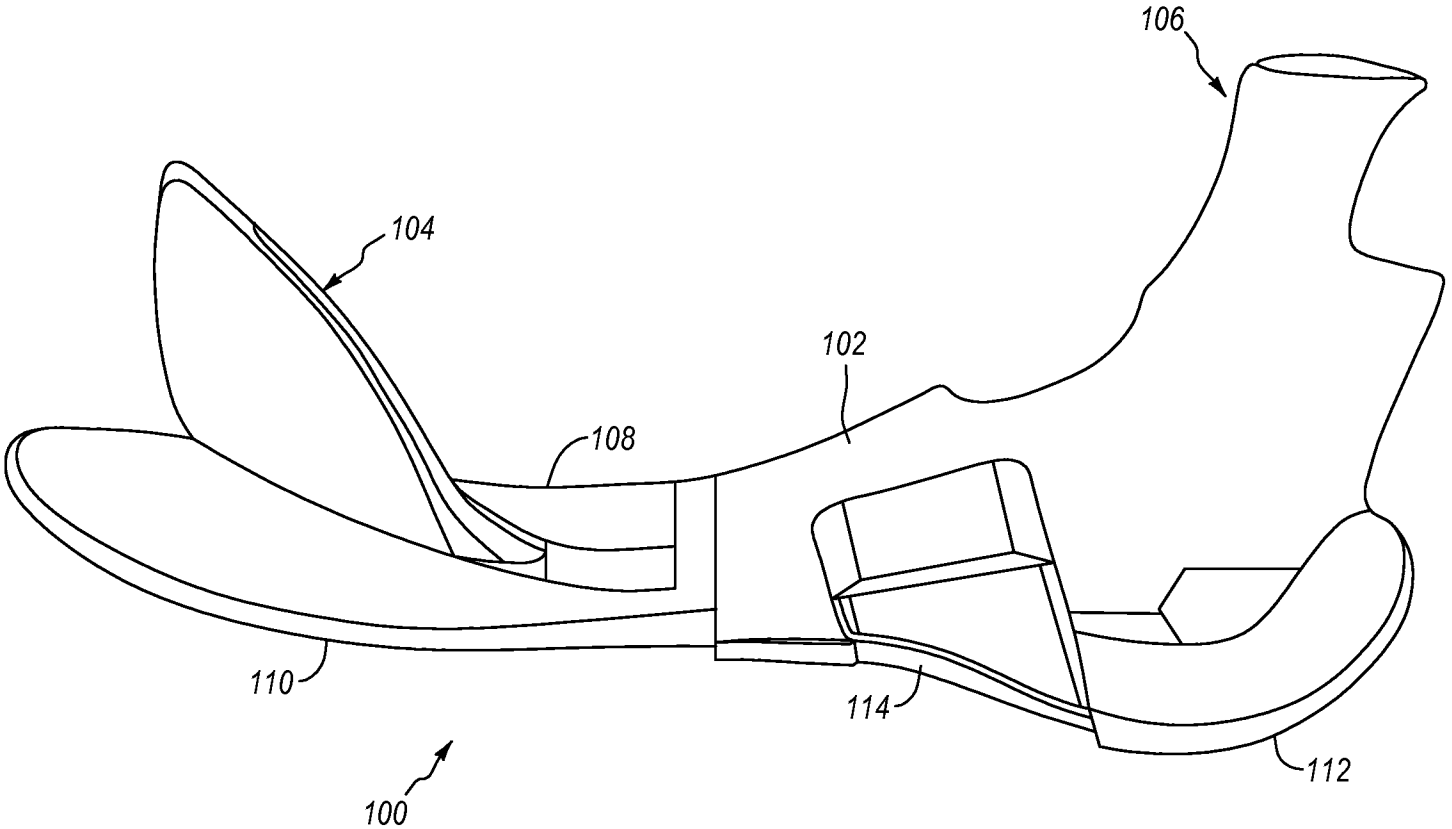
FIG. 1 is a side view of a saddle core made in accordance with the present disclosure.

One or more implementations of the present disclosure relate to the manufacturing of lightweight, weather resistant saddles. A saddle according to the present disclosure may include all the advantages of traditional saddle making techniques without incurring the cost, labor, materials, or time of the traditional techniques. A method of manufacture is presented herein including the use of modern materials and techniques to save time and money.

A saddle according to the present disclosure may comprise a synthetic core and a synthetic reinforcement layer that are much lighter, stronger, and faster to produce than their traditional counterparts. The saddle may then be finished with a finishing layer. The finishing layer may comprise leather and produce a saddle that appears identical to a traditional saddle with improvements in performance, weight, cost, durability, or combinations thereof. To produce a saddle according to the present disclosure, a synthetic core may be injection molded, and then a reinforcement layer may be applied over the synthetic core similar to building up a traditional wooden saddletree with leather. However, the reinforcement layer may require less material than is normally used because the synthetic material used in the reinforcement layer may be thinner and lighter than the traditional leather. The reinforcement layer may then be hardened in place to impart strength and durability. After hardening the reinforcement layer, the saddle may substantially achieve in its final shape. An application of a finishing layer results in an easily and quickly produced high-quality saddle.

Traditional saddles may be manufactured by building up layers of leather over a wooden saddletree that functions as an underlying frame within the saddle. However, these saddletrees can be very simple frames that are a mere skeleton of the final product, requiring considerable time, materials, and skill to convert into a high-quality saddle. The wooden frame will have many layers of leather applied to the saddle to create the final shape of the cantle, seat, horn, and rigging points. Leather is a fairly durable natural material, however, even leather is subject to failure during the course of a saddle's use.

A saddle will be used in nearly all conditions, from intense heat and sun on summer days through heavy rainfall and even including snow and sub-freezing conditions. Because the structure of the saddle may be at least semi permeable to water, the cycles of dry days and wet days, as well as freeze-thaw cycles will work to damage a traditional saddle. In contrast, a saddle with an injection molded core and synthetic reinforcement layer may allow the majority of the saddle to be synthetic. Producing a saddle that is primarily synthetic underneath an outer finishing layer may render the bulk of the saddle impervious to water and, therefore, most weather.

Additionally, the injection molding process may enable complex shapes to be produced in relatively large quantities with high accuracy faster than traditional saddlemaking. While a traditional saddle requires considerable time, skill, and expense in producing the saddletree itself, an injection molded core may produce a more complete form faster, thereby reducing manufacturing time and cost.

Referring to FIG. 1, saddle 100 may comprise core 102. In some embodiments, the core 102 may be a solid saddletree for the saddle 100. In other embodiments, the core 102 may include a plurality of components molded independently and connected to assemble the core 102. For example, the core 102 may include a plurality of components connected by bonding (e.g., sonic welding of polymeric materials), adhesives, interlocking portions of the components, mechanical fasteners (e.g., rivets, bolts, screws, nails, clamps), or combinations thereof. Core 102 may be manufactured by a process including injection molding. Injection molding may allow core 102 to be formed with an integrated cantle 104, horn 106, and seat 108. Seat 108 may be a solid seat as opposed to an open seat such as that of a traditional wooden saddletree. A solid seat may save time, materials, and labor by reducing or eliminating the need to build the seat up with leather layers as would be required with an open seat. Furthermore, rear bars 110 and front bars 112 may be formed integrally to the core 102 to provide a single, monolithic core that includes the cantle 104, horn 106, seat 108, rear bars 110, and front bars 112 without any seams, mechanical fasteners, other connections that may concentrate applied forces, or combinations thereof.

In an embodiment, the front bars 112 may be flared to increase range of movement for the horse by reducing pressure on the scapula of the horse. Integration of the rear and front bars 110, 112 with the core 102 increases the durability and strength of the saddle 100. Additionally, it may provide precise control over the spacing of the rear bars 110 and front bars 112. The placement of the rear bars 110, for example, may determine the fit of the saddle 100 relative to the horse and may at least partially determine how secure and comfortable the saddle 100 is on the horse. In an embodiment, the rear bars 110 may be spaced in a range having upper and lower values including 12.5 inches, 12.75 inches, 13.0 inches, 13.25 inches, 13.5 inches, 13.75 inches, 14.0 inches, 14.25 inches, 14.5 inches, or any value therebetween. For example, the rear bars 110 may be spaced between about 12.5 inches to about 14.5 inches apart. In another example, the rear bars 110 may be spaced between about 13.0 inches to about 14.0 inches apart. In yet another example, the rear bars 110 may be spaced about 13.22 inches apart.

The core 102 may also be formed with integrated rigging points 114. The integrated rigging points 114 may allow for an aperture in the core 102 through which one or more parts of a rigging may be passed. The integrated rigging points 114 save time during manufacturing and allow for stronger rigging points 114 with less weight to the saddle 100. The integrated rigging points 114 may allow for force from the rigging to be transferred to the saddle 100 more efficiently (e.g., spread evenly across a larger surface) than at discrete connection points (e.g., mechanical fasteners) such as may be used on a traditional wooden saddletree. The integration of the integrated rigging points 114 in the core 102 may allow the integrated rigging points 114 to use less material than may be necessary with mechanically fastened or chemically adhered components. The integration of the integrated rigging points 114 in the core 102 may reduce the amount of areas and/or connections that may concentrate forces applied to the saddle 100, which may reduce the operational lifetime of the saddle 100.

Figure 2:
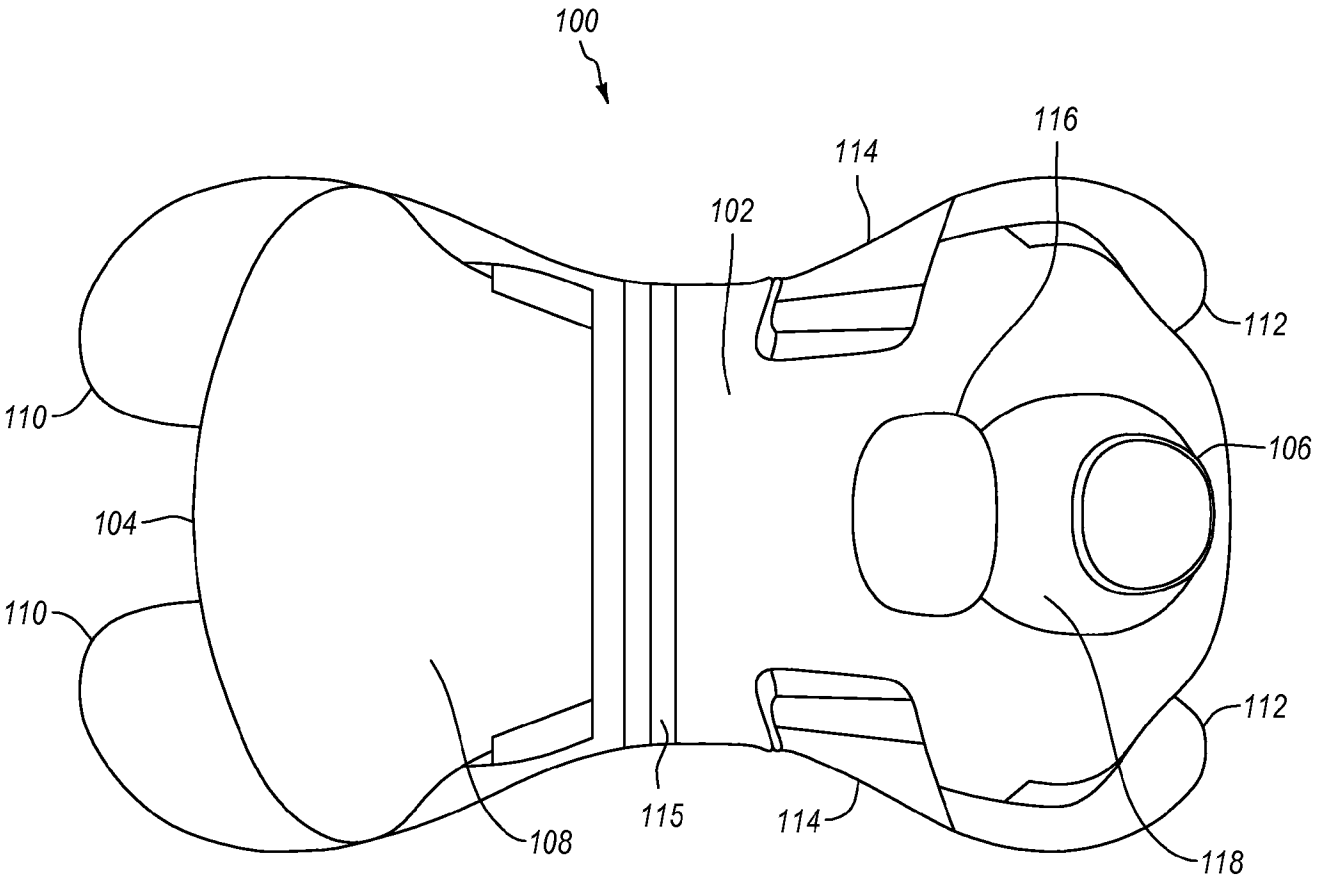
FIG. 2 is a top view of a saddle core made in accordance with the present disclosure.

Referring now to FIG. 2, the core 102 has a solid seat 108. As mentioned earlier, the solid seat 108 of the core 102 allows the final saddle 100 to be built with a solid seat 108 without having to fill in the open seat of a traditional saddletree using rawhide or other materials to produce a substantially hard seat for the rider. Therefore, the solid seat 108 of the core 102 may save time and material costs as compared to a traditional saddletree. The solid seat 108 may distribute weight more efficiently than an open seat. The more efficient distribution of weight may the saddle 100 to support a greater amount of weight with less material, further reducing the weight of the saddle 100. Reducing the weight of the saddle 100 may improve ease of use for a rider and comfort for a horse. A completely solid core 102 through the center portion of the core 102 may increase durability of the saddle 100. The solid seat 108 may distribute forces, such as compressive force and/or torque, across the entire solid seat 108. The distribution of forces across the entire solid seat 108 may allow the core 102 to withstand increased force and/or torque with less material, thereby reducing weight and improving operational lifetime of the saddle 100.

In some embodiments of a core 102 having multiple components, the core 102 may include one or more inserts 115 positioned between the solid seat 108 and the integrated rigging points 114. The inserts 115 may allow the core 102 to be longitudinally extended to adjust the length of the core 102 to accommodate riders and/or horses of different sizes. The inserts 115 may allow longitudinal adjustments of the core 102 such that the core may be adjusted to the proper length prior to covering the core with one or more layers of reinforcement material and/or leather. For example, a core 102 may have a length measured from the cantle 104 to the fork 118. The length of the core 102 may be within a range having upper and lower values including 14.5 inches, 14.75 inches, 15.0 inches, 15.25 inches, 15.5 inches, 15.75 inches, 16.0 inches, 16.25 inches, 16.5 inches, 16.75 inches, 17.0 inches, or any value therebetween. For example, the length of the core 102 may be between 14.5 inches and 17.0 inches. In another example, the length of the core 102 may be between about 14.5 inches and 15.0 inches. In yet another example, the length of the core 102 may be between about 15.5 inches and 16.0 inches. In a further example, the length of the core 102 may be between about 16.5 inches and 17.0 inches.

The core 102 may include an opening 116 near the fork 118 of the saddle 100. The opening 116 may allow the saddle 100 to be lighter in weight than a core 102 without and opening 116 while introducing little or no degradation in strength of the saddle 100. However, the regions at and/or around the opening 116 including the integrated rigging points 114 and the horn 106 may be points on the saddle 100 that may receive an application of additional force during use. Furthermore, the core 102 may not by itself be strong enough to fulfill the needs of a rider. Therefore, the core 102 may need to be reinforced. The reinforcement of the core 102 may be accomplished by the application of a reinforcement layer 120, as can be seen in FIG. 3.

Figure 3:
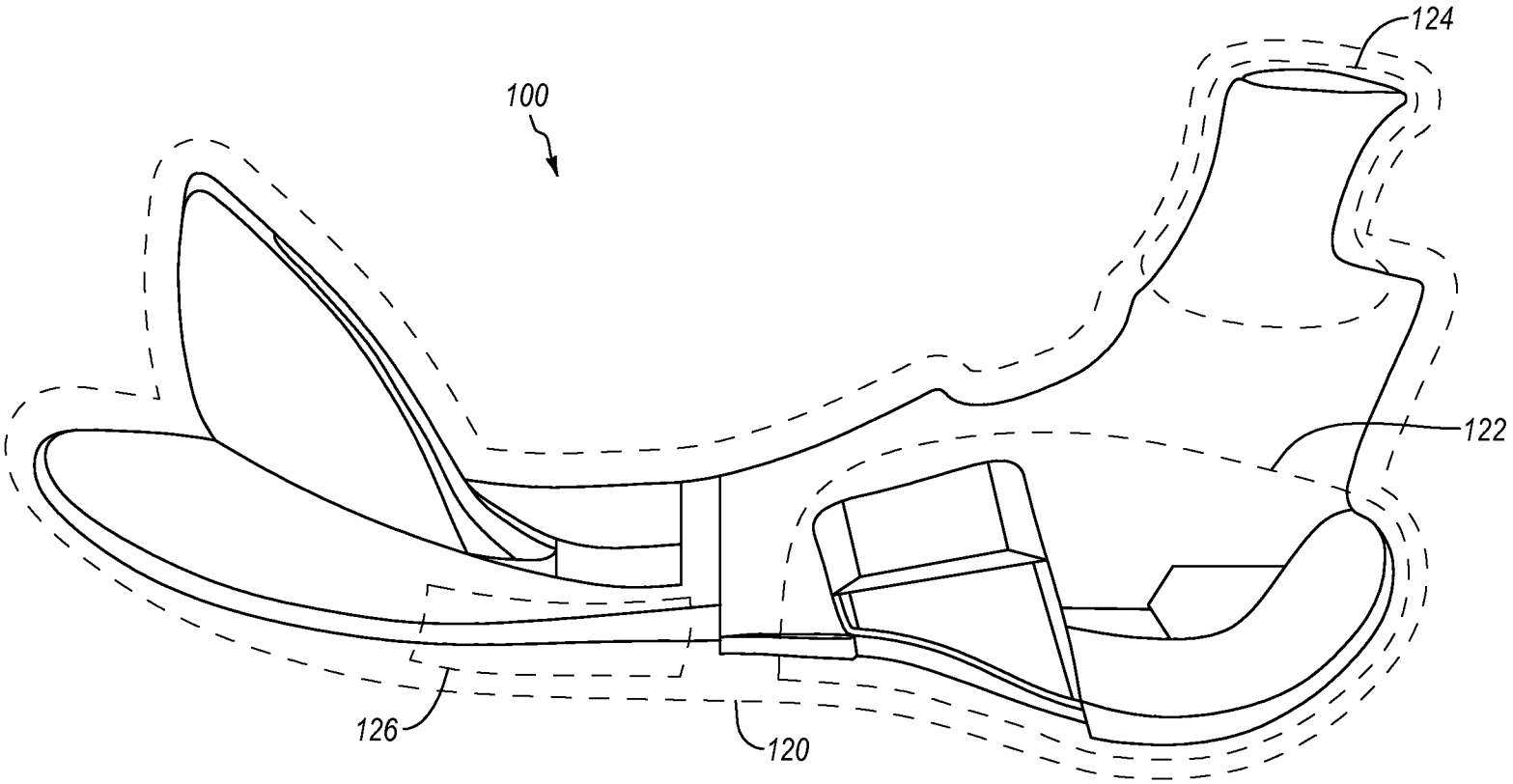
FIG. 3 is a schematic side view of the saddle core of FIG. 1 having a reinforcement layer applied thereto.

As shown in FIG. 3, in some embodiments, the reinforcement layer 120 may fully encapsulate the core 102. In other embodiments, the reinforcement layer 120 may not fully encapsulate the core 102. The final saddle 100 may be more durable and more resistant to weather if the reinforcement layer 120 seals the core 102. The reinforcement layer 120 may or may not be uniform. For example, the reinforcement layer 120 may vary in thickness over the surface of the core 102. In another example, the reinforcement later 120 may vary in material over the surface of the core 102. In yet another example, the reinforcement layer 120 may vary in layering direction (e.g., carbon fiber layering). In yet further examples, the reinforcement layer 120 may be asymmetrical.

There may be one or more points on the core 102 that may need greater reinforcement than a single layer of reinforcement material in the reinforcement layer 120 may provide. For example, an additional layer of reinforcement material or additional reinforcement material within the reinforcement layer 120 may be applied to the front rigging portion 122, rear rigging portion 124, the horn portion 126, or combinations thereof. If an additional layer of reinforcement material is used in the front rigging portion 122, the rear rigging portion 124, the horn portion 126, or combinations thereof, the additional layer may be disposed underneath or on top of a main layer of material in the reinforcement layer 120. In an embodiment, the reinforcement material in the reinforcement layer 120 may comprise a toughened epoxy glass pre-impregnated material, commonly known as "e-glass." In another embodiment, the reinforcement material in the reinforcement layer 120 may comprise KEVLAR. In yet another embodiment, the reinforcement material in the reinforcement layer 120 may comprise carbon fiber.

Figure 4:
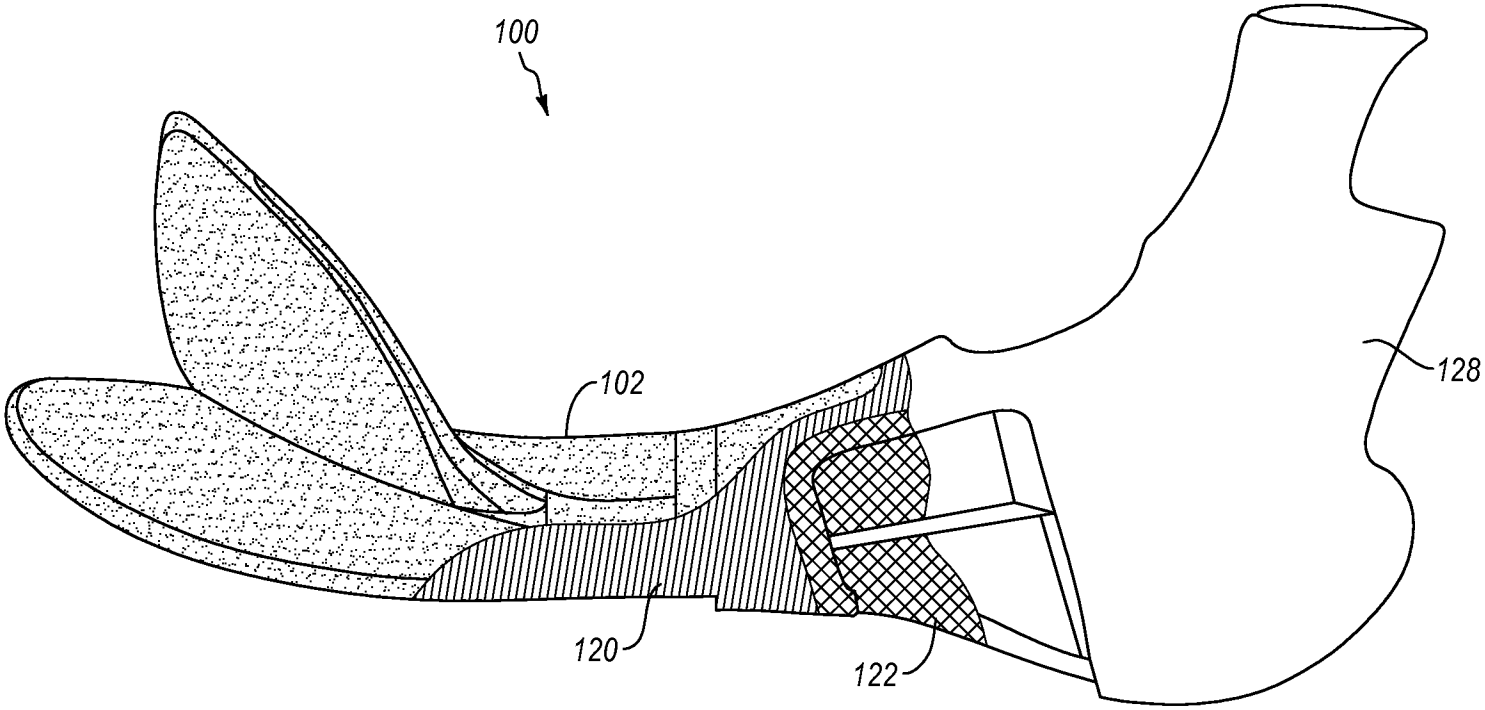
FIG. 4 is a cutaway side view of a saddle in accordance with the present disclosure.

As shown in FIG. 4, the reinforcement layer 120 may have a finishing layer 128 disposed upon it. The finishing layer 128 may comprise leather. Because the structural rigidity and strength of the saddle 100 arises from the synthetic core 102 and the synthetic reinforcement layer 120, the saddle 100 does not rely upon the finishing layer 128 to protect the saddle 100 from the elements. Therefore, the finishing layer 128 may comprise softer and thinner leather than a traditional saddle without concern for a substantial loss of durability or performance. The seamless synthetic core 102 will resist the swelling and contraction that are normally associated with temperature and humidity changes. Expansion and contraction of components of a saddle due to weather and use may loosen contact points of components in the saddle and accelerate the degradation of the saddle. A seamless synthetic core with a synthetic reinforcement layer may render much of the saddle water resistant, and therefore, more durable.

Figure 5:
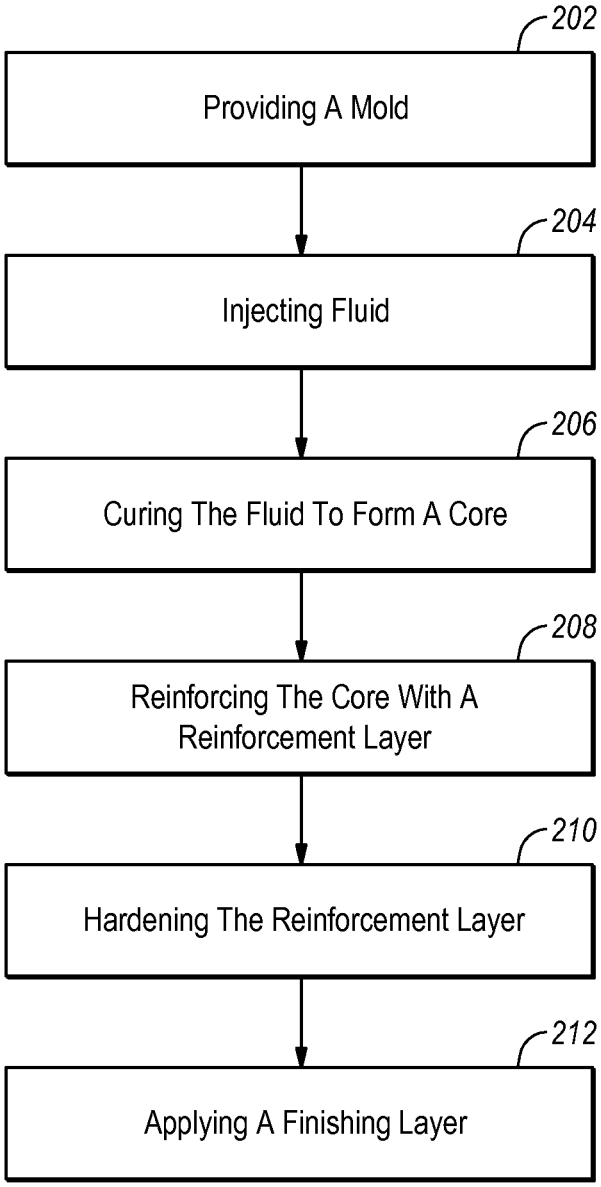
FIG. 5 is a schematic diagram depicting a method of saddle manufacture.

A method of manufacture of a saddle 100, as described above, is also described herein and is depicted in FIG. 5. The method may begin by providing 202 a mold for the core 102. The mold may optionally include a removable insert. The removable insert may allow the mold to change dimensions such that the injected-molded core 102 may match a desired final dimension of the saddle 100. For example, the mold may have a removable insert disposed longitudinally in the mold. In some embodiments, the mold may have a removable insert positioned between a portion of the mold that may form the solid seat 108 and the integrated rigging points 114. Such an insert may allow an operator to use a single mold to produce synthetic cores, and thereby saddles, with substantial changes to saddle length. Alternatively, the mold may have removable inserts that affix to an interior surface of the mold to alter other dimensions of the produced core. For example, the mold may have a removable insert that allow for the adjustment of a height of the cantle or an amount of rocker in the bars.

To form the core 102, the method may include injecting 204 a curable fluid into the mold. The term "curable fluid," as used herein, is any material that is fluid during injection into the mold, but may be selectively hardened into a substantially solid phase and remain solid at room temperature. This may be accomplished through an application of energy, such as heating, or through a chemical reaction, such as the addition of a hardening agent in an epoxy. In additional, a fluid may be curable through the removal of energy, such as cooling. The curable fluid may comprise a liquid, a semi-liquid (such as a gel), a gas, or any combination of such phases. Furthermore, the curable fluid may comprise solid particles suspended in a fluid medium such that the suspension is injectable into a mold. In an embodiment, the curable fluid may comprise foam. In another embodiment, the foam may comprise urethane or a similar polymer. Upon injection, the curable fluid may expand to fill the interior of the mold.

Still referring to FIG. 5, the method may include curing 206 the curable fluid may then be cured until workable. "Workable," as used herein, means that the cured fluid is substantially solid at room temperature and may be moved as a single, cohesive piece. The curing may be accomplished by heating of the curable fluid and/or the mold. Once the curable fluid is cured until workable, the fluid may substantially attain the shape of the core 102. After removal from the mold, the cured fluid may be trimmed and/or sanded to the desired final product size and to form the core 102. The resulting core 102 may be substantially impervious to weather. The core 102 may be the frame upon which a reinforcement layer 120 is built in order to strengthen the core 102.

Reinforcing the core 208 with a reinforcement layer 120 may be performed by hand to build up the saddle 100 to substantially its final shape and provide a stronger structure than the core 102 alone. As mentioned earlier, in an embodiment, the reinforcement layer 120 may comprise a toughened epoxy glass pre-impregnated material, commonly known as "e-glass." In another embodiment, the reinforcement layer 120 may comprise KEVLAR. The reinforcement layer 120 may comprise material applied in individual pieces, which are layered upon one another, or the reinforcement layer 120 may comprise material applied through mechanical means, such as a spray or other delivery device. The reinforcement layer 120 may be applied while the material is still pliable.

The distribution of reinforcement layer 120 may not be uniform across the surface of the core 102. The reinforcement layer may be stronger in selected areas. In an embodiment, the selected areas may comprise the front rigging portion 122, the rear rigging portion 124, and the horn portion 126. The horn portion 126 may comprise the horn and a fork. The horn portion 126 may, for example, be used as an anchor point for a rope to apply force from the horse on another object. Not only does the horn portion 126, therefore, need to be strong enough to transmit as much lateral force as a horse can generate, but a failure of the horn portion 126 during such a situation could cause a potential danger for the horse and anyone else in the vicinity. In addition, the riggings of the saddle need to be sufficiently strong to distribute the forces created during riding and work. In particular, the front rigging portion 122, may require additional reinforcement as compared to the remainder of the core 102.

In addition or in alternative, the strength of the reinforcement layer may be anisotropic. For example, the reinforcement layer may preferentially flex in one direction while maintaining rigidity in another. In practice, unidirectional compliance may increase the comfort of the saddle 100 for the horse and the rider while still providing the requisite strength during forceful riding.

After reinforcing 208 the core with the application of the reinforcement layer 120, the reinforcement layer 120 may be hardened. To maintain the desired structure during hardening, a saddletree including the synthetic core 102 and the reinforcement layer 120 may be sealed within a compressive wrap. The compressive wrap may comprise a vacuum bag. The compressive wrap holds the reinforcement layer 120 in place during the hardening process. In an embodiment, hardening 210 the reinforcement layer 120 may comprise a heating of the reinforcement layer 120. In a further embodiment, the hardening of the reinforcement layer 120 may comprise heating the reinforcement later 120 at a low heat of approximately 225° F. for at least one hour. In another embodiment, the hardening may comprise exposing the reinforcement layer to air. In yet another embodiment, the hardening may comprise adding a chemical agent.

Finally, the method may include applying 212 a finishing layer 128 to the hardened reinforcement layer 120 to substantially complete the saddle 100. The application of the finishing layer 128 may be completed by hand and to a user's specification. The finishing layer 128 may comprise any material desired to provide the aesthetics and performance required. In an embodiment, the finishing layer 128 may comprise leather. In another embodiment, the finishing layer 128 may comprise light leather since the finishing layer 128 does not need to be weatherproof when the saddletree comprises a synthetic core 102 and a synthetic reinforcement layer 120.

A saddle having a reinforced synthetic core may be cheaper to produce and result in a stronger, lighter, more durable saddle. A lighter and stronger saddle may provide performance and comfort benefits to both a rider and a horse.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. Any element of an embodiment described herein may be combined with any element of any other embodiment described herein. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "forward" and "rearward" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of manufacture of a saddle, comprising:

injecting a curable fluid into a mold;

curing the curable fluid at least until workable to create a monolithic core having a cantle, horn, and solid seat each formed from the same curable fluid;

removing the core from the mold;

after removal of the core from the mold, reinforcing the core with a reinforcement layer, the reinforcement layer being formed of a material distinct from the molded core;

hardening the reinforcement layer; and applying a finishing layer to the reinforcement layer.

2. The method of claim 1, wherein the curable fluid comprises foam.

3. The method of claim 2, wherein the foam comprises urethane.

4. The method of claim 1, wherein the core comprises one or more inserts between the solid seat and one or more integrated rigging points, the one or more inserts being configured for adjusting a length of the core.

5. The method of claim 1, wherein the reinforcement layer comprises an epoxy glass.

6. The method of claim 1, wherein the reinforcing the core further comprises reinforcing at least a part of the core more than a remainder of the core.

7. The method of claim 6, wherein the reinforcement layer varies in thickness over the surface of the core.

8. The method of claim 1, wherein the hardening the reinforcement layer comprises heating the reinforcement layer.

9. The method of claim 8, wherein the heating the reinforcement layer comprises subjecting the reinforcement layer to about 225° F. for at least 1 hour.

10. The method of claim 9, wherein the heating the reinforcement layer further comprises enclosing the reinforcement layer in a compressive wrapping.

11. The method of claim 1, wherein the applying the finishing layer comprises hand building the finishing layer.

12. The method of claim 1, wherein the finishing layer comprises leather.

13. The method of claim 1, wherein the reinforcement layer fully encapsulates and seals the core.

14. A method of manufacture of a saddle, comprising:

injecting a curable fluid into a mold to create a monolithic core having a cantle, horn, and solid seat each formed from the same curable fluid;

curing the curable fluid at least until workable to create a synthetic saddle tree comprising the cantle, horn, and solid seat;

subsequent to creation of the saddle tree, removing the core from the mold and reinforcing the saddle tree with a reinforcement layer, the reinforcement layer being applied non-uniformly so as to provide greater reinforcement at a horn portion and at one or more rigging portions than at a seat, the reinforcement layer fully encapsulating the saddle tree;

hardening the reinforcement layer; and applying a finishing layer to the reinforcement layer, the finishing layer fully encapsulating the reinforcement layer.

15. The method of claim 14, wherein the finishing layer comprises leather.

16. The method of claim 14, wherein the synthetic saddle tree comprises rear bars separated by a width of about 12.5 inches to about 14.5 inches.

17. The method of claim 14, wherein the synthetic saddle tree comprises integrated rigging points.

18. The method of claim 14, further comprising removing the saddle tree from the mold prior to reinforcing the saddle tree with the reinforcement layer.

19. A method of manufacture of a saddle, comprising:

injecting a curable fluid into a mold;

curing the curable fluid at least until workable to create a monolithic core having a cantle, horn, and solid seat each formed from the same curable fluid;

removing the core from the mold;

after removing the core from the mold, reinforcing the saddle tree with a reinforcement layer, the reinforcement layer being applied non-uniformly so as to provide stronger reinforcement at the horn and at one or more rigging portions than at the solid seat, the reinforcement layer fully encapsulating and sealing the core;

hardening the reinforcement layer; and applying a finishing layer to the reinforcement layer.

* * * * *